US010586510B2

(12) United States Patent
Jun et al.

(10) Patent No.: US 10,586,510 B2
(45) **Date of Patent: *Mar. 10, 2020**

(54) STAIN COMPENSATING APPARATUS FOR DISPLAY PANEL, METHOD OF COMPENSATING STAIN USING THE SAME AND METHOD OF DRIVING DISPLAY PANEL HAVING THE METHOD OF COMPENSATING STAIN

(71) Applicant: SAMSUNG DISPLAY CO., LTD., Yongin-si, Gyeonggi-Do (KR)

(72) Inventors: Byung-Geun Jun, Seoul (KR); Dan-Bi Kim, Hwaseong-si (KR); In-Hwan Kim, Asan-si (KR); Ui-Yeong Cha, Hwaseong-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/186,778

(22) Filed: Nov. 12, 2018

(65) Prior Publication Data

US 2019/0080671 A1 Mar. 14, 2019

Related U.S. Application Data

(63) Continuation of application No. 15/388,293, filed on Dec. 22, 2016, now Pat. No. 10,147,391.

(30) Foreign Application Priority Data

Jan. 20, 2016 (KR) ..... 10-2016-0007040

(51) Int. Cl.
*G09G 5/10* (2006.01)

(52) U.S. Cl.
CPC ..... *G09G 5/10* (2013.01); *G09G 2310/08* (2013.01); *G09G 2320/0276* (2013.01); *G09G 2320/0295* (2013.01); *G09G 2320/0626* (2013.01); *G09G 2320/0693* (2013.01); *G09G 2330/10* (2013.01); *G09G 2330/12* (2013.01); *G09G 2360/147* (2013.01); *G09G 2360/16* (2013.01)

(58) Field of Classification Search
CPC ..... G09G 2320/0626; G09G 5/10; G09G 2320/0295; G09G 2320/0276; G09G 2360/147; G09G 2310/08; G09G 2360/16
See application file for complete search history.

(56) References Cited

U.S. PATENT DOCUMENTS

2013/0201180 A1 8/2013 Jeon et al.
2016/0196778 A1 7/2016 Cha
2017/0206859 A1 7/2017 Jun et al.

FOREIGN PATENT DOCUMENTS

KR 10-2014-00866619 7/2014

*Primary Examiner* — Muhammad N Edun
(74) *Attorney, Agent, or Firm* — F. Chau & Associates, LLC

(57) ABSTRACT

A stain compensating apparatus includes a camera, an input signal processing part, an edge compensating part and a stain compensating value generating part. The camera captures a display image from the display panel. The input signal processing part generates a luminance profile based on the display image captured by the camera. The edge compensating part compensates the luminance profile of a curved portion of the display panel. The stain compensating value generating part generates a stain compensating value for a pixel of the display panel using the compensated luminance profile.

20 Claims, 11 Drawing Sheets

FIG. 9A

| | PC1 | PC2 | PC3 |
|---|---|---|---|
| PR1 | LM+1 | LM | LM+3 |
| PR2 | LM-1 | LM | LM |
| PR3 | LM | LM-2 | LM+4 |
| PR4 | LM | LM | LM |
| PR5 | LM-3 | LM-2 | LM |

D1
D2

FIG. 9B

| | PC1 | PC2 | PC3 |
|---|---|---|---|
| PR1 | -X | 0 | -3X |
| PR2 | X | 0 | 0 |
| PR3 | 0 | 2X | -4X |
| PR4 | 0 | 0 | 0 |
| PR5 | 3X | 2X | 0 |

D1
D2

STAIN COMPENSATING APPARATUS FOR DISPLAY PANEL, METHOD OF COMPENSATING STAIN USING THE SAME AND METHOD OF DRIVING DISPLAY PANEL HAVING THE METHOD OF COMPENSATING STAIN

CROSS REFERENCE TO RELATED APPLICATIONS

This application is a continuation of U.S. application Ser. No. 15/388,293, filed on Dec. 22, 2016 in the U.S. Patent and Trademark Office, which in turn claims priority under 35 U.S.C. § 119 from, and the benefit of, Korean Patent Application No. 10-2016-0007040, filed on Jan. 20, 2016 in the Korean Intellectual Property Office KIPO, the contents of both of which are herein incorporated by reference in their entireties.

BACKGROUND

1. Technical Field

Exemplary embodiments of the present inventive concept are directed to a stain compensating apparatus for a display panel, a method of compensating stain in a display panel using the same and a method of driving a display panel that includes a method of compensating stain in the display panel. More particularly, exemplary embodiments of the present inventive concept are directed to a stain compensating apparatus for a display panel that can improve display quality, a method of compensating stain in a display panel using the same and a method of driving a display panel that includes the method of compensating stain in the display panel.

2. Discussion of the Related Art

Due to the manufacturing steps involved with fabricating a display panel, the luminance of the display panel may not be uniform. Thus, the display panel may have a stain. To compensate the stain, a method of compensating the stain can be performed.

When a display panel includes a curved portion, a stain in the curved portion may not be properly compensated by conventional methods of compensating the stain.

SUMMARY

Exemplary embodiments of the present inventive concept can provide a stain compensating apparatus for a method of improving display quality.

Exemplary embodiments of the present inventive concept can also provide a method of compensating stains in a display panel using a stain compensating apparatus.

Exemplary embodiments of the present inventive concept can also provide a method of driving a display panel that includes a method of compensating stains in a display panel.

In an exemplary embodiment of a stain compensating apparatus according to the present inventive concept, the stain compensating apparatus includes a camera, an input signal processing part, an edge compensating part and a stain compensating value generating part. The camera captures a display image from the display panel. The input signal processing part generates a luminance profile based on the display image captured by the camera. The edge compensating part compensates the luminance profile of a curved portion of the display panel. The stain compensating value generating part generates a stain compensating value for a pixel of the display panel using the compensated luminance profile.

In an exemplary embodiment, the curved portion is disposed at an end portion of the display panel in a first direction, and the input signal processing part may generate the luminance profile as a function of position along the first direction.

In an exemplary embodiment, the input signal processing part may generate the luminance profile using an average of luminances in a second direction crossing the first direction.

In an exemplary embodiment, the edge compensating part may determine an n-th order polynomial that minimizes differences between the n-th order polynomial and the luminance profile of the curved portion, and n is a natural number.

In an exemplary embodiment, the n-th order polynomial may have a form $a_n \times x^n + (a_{n-1}) \times x^{n-1} + (a_{n-2}) \times x^{n-2} + \ldots + a_1 \times x + a_0$, where $a_n$, $a_{n-1}$, $a_{n-2}$, . . . , $a_1$ and $a_0$ are real numbers.

In an exemplary embodiment, the stain compensating value generating part may generate the stain compensating value for each pixel. The stain compensating value for a pixel disposed at the curved portion of the display panel may be based on the compensated luminance profile.

In an exemplary embodiment, the stain compensating value generating part may generate a positive luminance compensating value for a pixel whose luminance is darker than an average luminance of the display panel and a negative luminance compensating value for a pixel whose luminance is brighter than the average luminance of the display panel.

In an exemplary embodiment of a method of compensating a stain of a display panel according to the present inventive concept, the method includes capturing a display image from the display panel, generating a luminance profile based on the display image, compensating the luminance profile of a curved portion of the display panel to generate a compensated luminance profile and generating a stain compensating value for a pixel of the display panel using the compensated luminance profile.

In an exemplary embodiment, the curved portion is disposed at an end portion of the display panel in a first direction, and the luminance profile is a function of position along the first direction.

In an exemplary embodiment, the luminance profile may be generated using an average of luminances in a second direction crossing the first direction.

In an exemplary embodiment, compensating the luminance profile may include determining an n-th order polynomial that minimizes differences between the n-th order polynomial and the luminance profile of the curved portion, and n is a natural number.

In an exemplary embodiment, the n-th order polynomial may have a form $a_n \times x^n + (a_{n-1}) \times x^{n-1} + (a_{n-2}) \times x^{n-2} + \ldots + a_1 \times x + a_0$, where $a_n$, $a_{-1}$, $a_{n-2}$, . . . , $a_1$ and $a_0$ are real numbers.

In an exemplary embodiment, the stain compensating value may be generated for each pixel. The stain compensating value for a pixel disposed at the curved portion of the display panel may be based on the compensated luminance profile.

In an exemplary embodiment, a positive luminance compensating value may be generated for a pixel whose luminance is darker than an average luminance of the display panel. A negative luminance compensating value may be generated for a pixel whose luminance is brighter than the average luminance of the display panel.

In an exemplary embodiment, the method of driving a display panel further includes compensating an input image data based on the stain compensating value, generating a data voltage based on the compensated input image data and outputting the data voltage to the display panel.

In an exemplary embodiment of a stain compensating apparatus according to the present inventive concept, the stain compensating apparatus includes an input signal processing part, an edge compensating part, and a stain compensating value generating part. The input signal processing part generates a luminance profile based on a display image. The edge compensating part that compensates the luminance profile of a curved portion of the display panel by determining an n-th order polynomial that minimizes differences between the n-th order polynomial and the luminance profile of the curved portion, wherein n is a natural number. The stain compensating value generating part that generates a stain compensating value for a pixel of the display panel using the compensated luminance profile.

In an exemplary embodiment, the curved portion may be disposed at an end portion of the display panel in a first direction, and the luminance profile may be a function of position along the first direction generated using an average of luminances in a second direction perpendicular to the first direction.

In an exemplary embodiment, the n-th order polynomial may have a form $a_n \times x^n + (a_{n-1}) \times x^{n-1} + (a_{n-2}) \times x^{n-2} + \ldots + a_1 \times x + a_0$, wherein $a_{n-1}$, $a_{n-2}$, . . . , $a_1$ and $a_0$ are real numbers.

In an exemplary embodiment, the stain compensating value generating part may generate the stain compensating value for each pixel, and the stain compensating value generating part may generate a positive luminance compensating value for the pixel whose luminance is darker than an average luminance of the display panel and a negative luminance compensating value for a pixel whose luminance is brighter than the average luminance of the display panel.

In an exemplary embodiment, the stain compensating apparatus further includes a camera that captures the display image from the display panel.

According to embodiments, a stain compensating apparatus, a method of compensating stains of a display panel using the stain compensating apparatus, and a method of driving a display panel that includes a method of compensating stains of a display panel, can properly compensate stains in curved portions of a display panel and improve display quality of the display panel.

BRIEF DESCRIPTION OF THE DRAWINGS

FIGS. 9A and 9B are conceptual diagrams that illustrate a method of generating a stain compensating value by a stain compensating value generating part of FIG. 3.

DETAILED DESCRIPTION OF EXEMPLARY EMBODIMENTS

Hereinafter, exemplary embodiments of the present inventive concept will be explained in detail with reference to the accompanying drawings.

Figure 1:
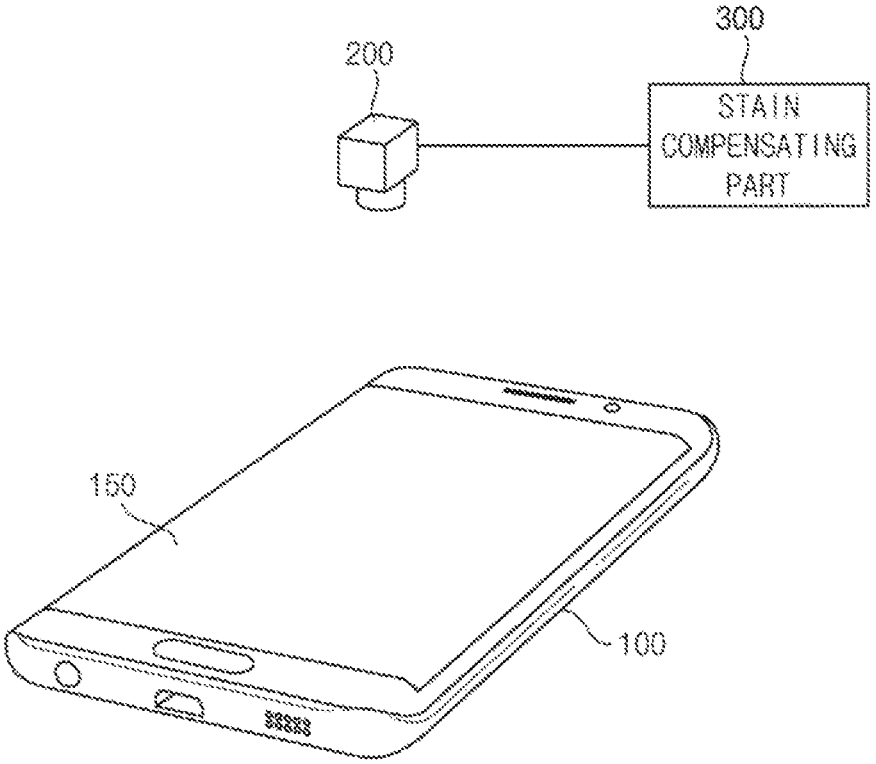
FIG. 1 illustrates a display apparatus and a stain compensating apparatus according to an exemplary embodiment of the present inventive concept.
Figure 2:
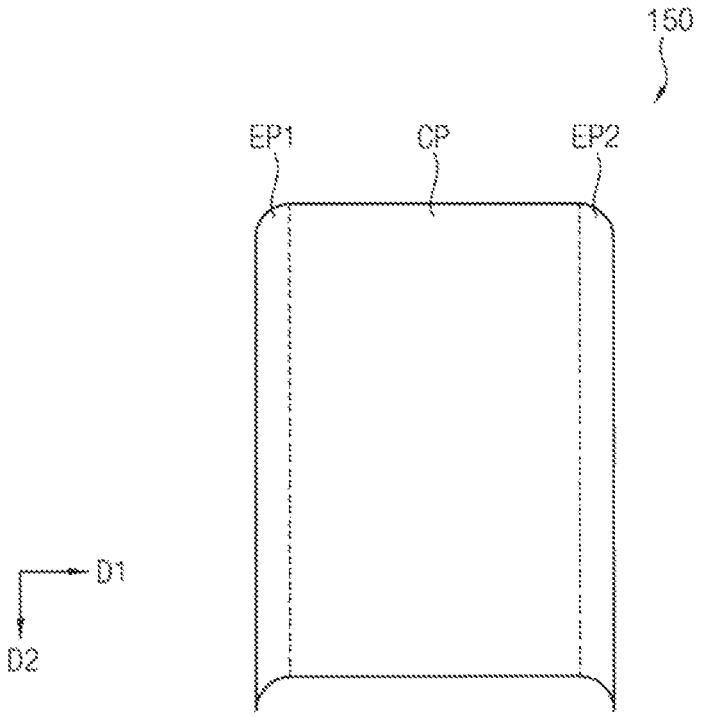
FIG. 2 is a perspective view of a display panel of FIG. 1.

FIG. 1 illustrates a display apparatus and a stain compensating apparatus according to an exemplary embodiment of the present inventive concept. FIG. 2 is a perspective view of a display panel of FIG. 1.

Referring to FIGS. 1 and 2, a display apparatus 100 includes a display panel 150 and a display panel driver that drives the display panel 150.

According to an embodiment, the display panel 150 has a rectangular shape in a plan view. For example, the display panel 150 has a shorter side in a first direction D1 and a longer side in a second direction D2 crossing the first direction D1. In some embodiments, the first direction D1 is perpendicular to the second direction D2.

According to an embodiment, the display panel 150 includes a central portion CP which has a flat upper surface and edge portions EP1 and EP2 which have a curved upper surface. For example, the edge portion EP1 and EP2 may be disposed at both end portions of the display panel 150 in the first direction D1. For example, a first edge portion EP1 is disposed at a first end portion of the central portion CP. A second edge portion EP2 is disposed at a second end portion of the central portion CP. A height of the upper surface of the first edge portion EP1 decreases with increasing distance from the central portion CP. A height of the upper surface of the second edge portion EP2 decreases with increasing distance from the central portion CP.

According to an embodiment, the stain compensating apparatus includes a camera 200 and a stain compensating part 300. The camera 200 captures a display image from the display panel 150. The camera 200 is disposed over the display panel 150. The camera 200 may be disposed over a central point of the display panel 150 in the first direction D1 and in the second direction D2.

According to an embodiment, the stain compensating part 300 generates a stain compensating value to compensate the stain of the display panel 150 based on the display image captured by the camera 200. The stain compensating part 300 outputs the stain compensating value to the display panel driver of the display apparatus 100. The display panel driver corrects an input display image provided to the display apparatus 100 based on the stain compensating value to compensate the stain of the display panel 150 generated by the manufacturing process. Herein, the stain refers to an area having an abnormal luminance, such as a relatively high luminance or a relatively low luminance as compared to an average luminance.

Figure 3:
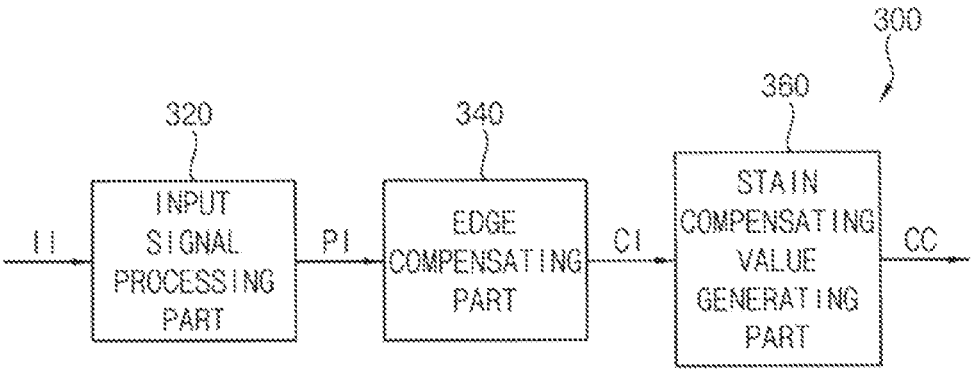
FIG. 3 is a block diagram of a stain compensating part of FIG. 1.
Figure 4:
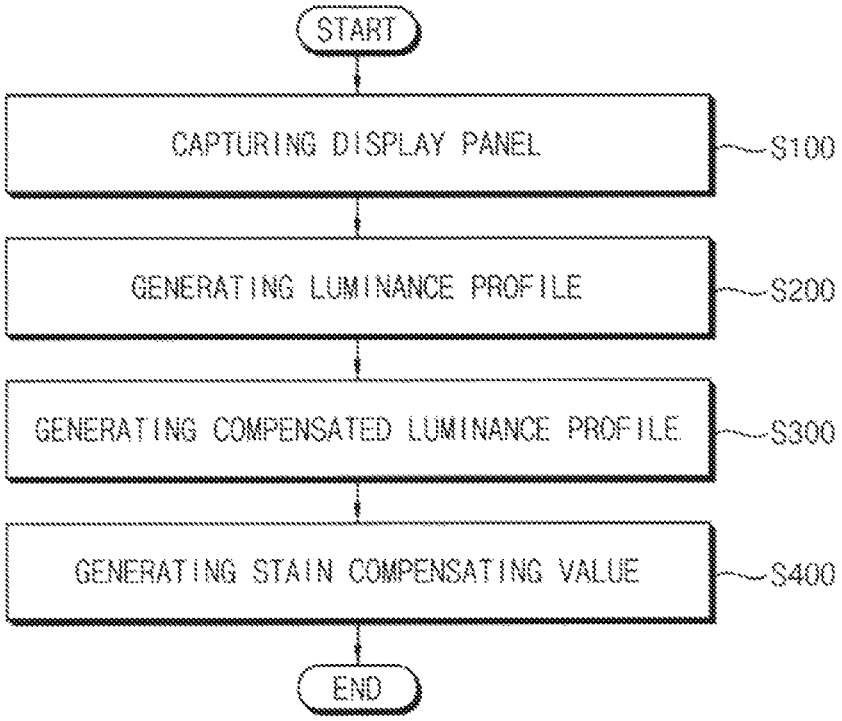
FIG. 4 is a flowchart of a method of compensating a stain in a display panel using a stain compensating apparatus of FIG. 1.
Figure 5A:
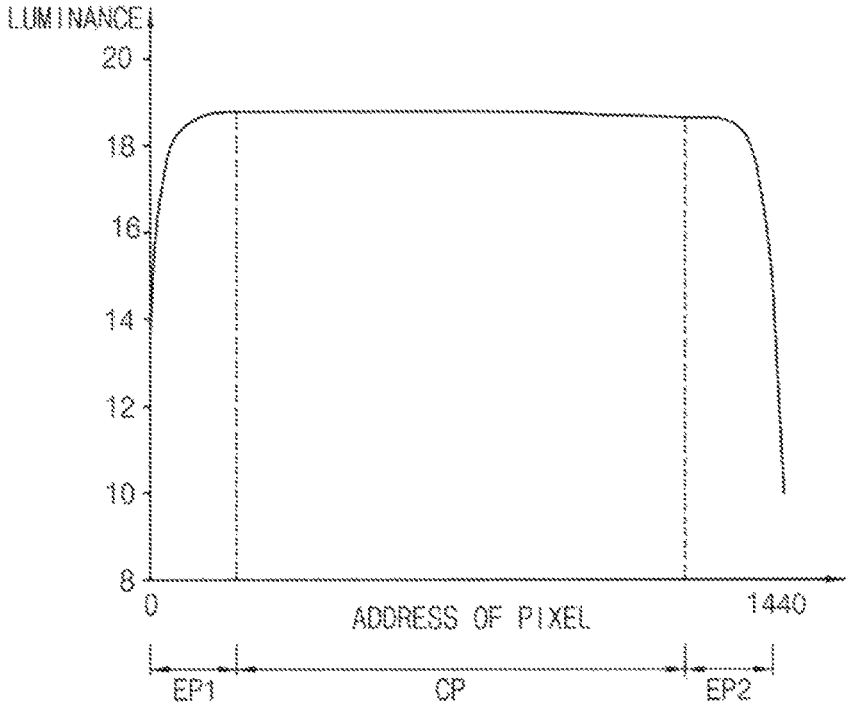
FIGS. 5A to 5C are graphs of a luminance profile of a display panel of FIG. 1.
Figure 5B:
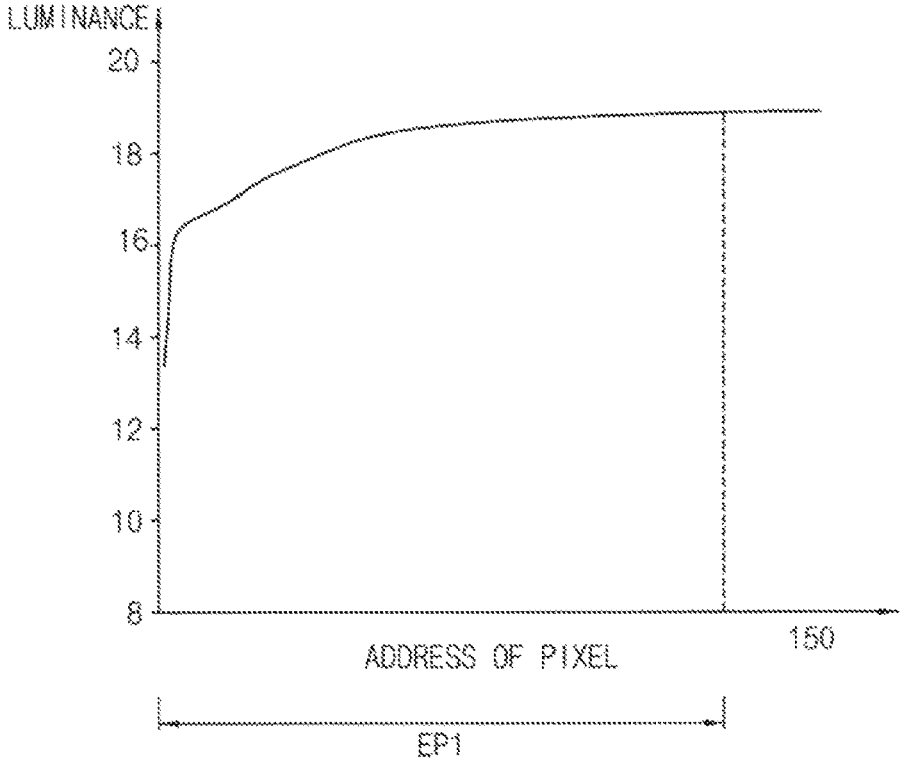
Figure 5C:
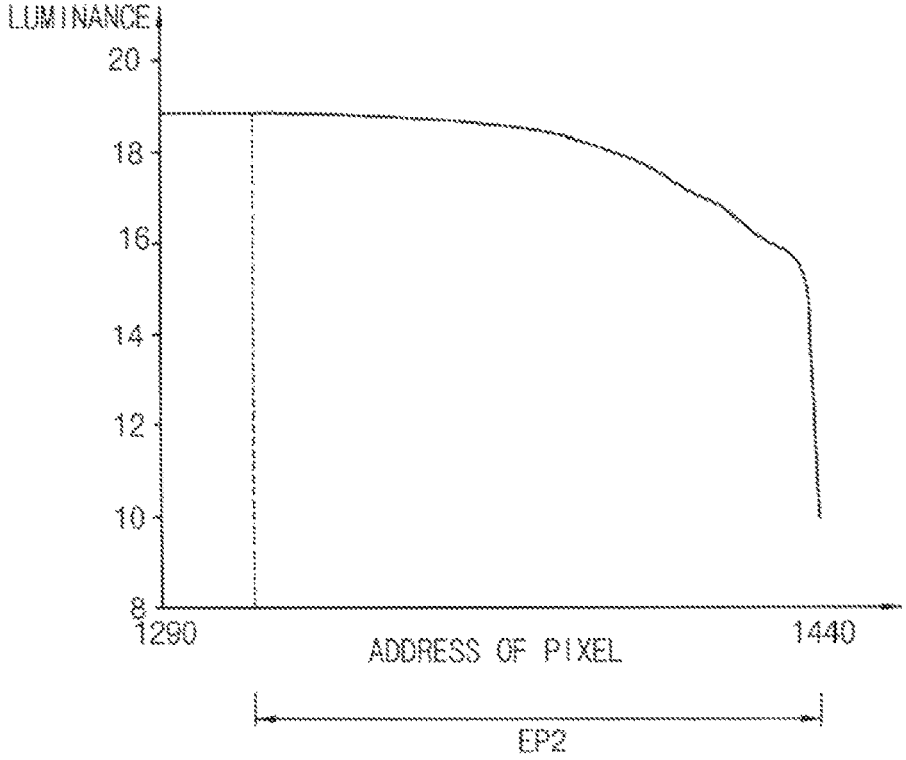
Figure 6A:
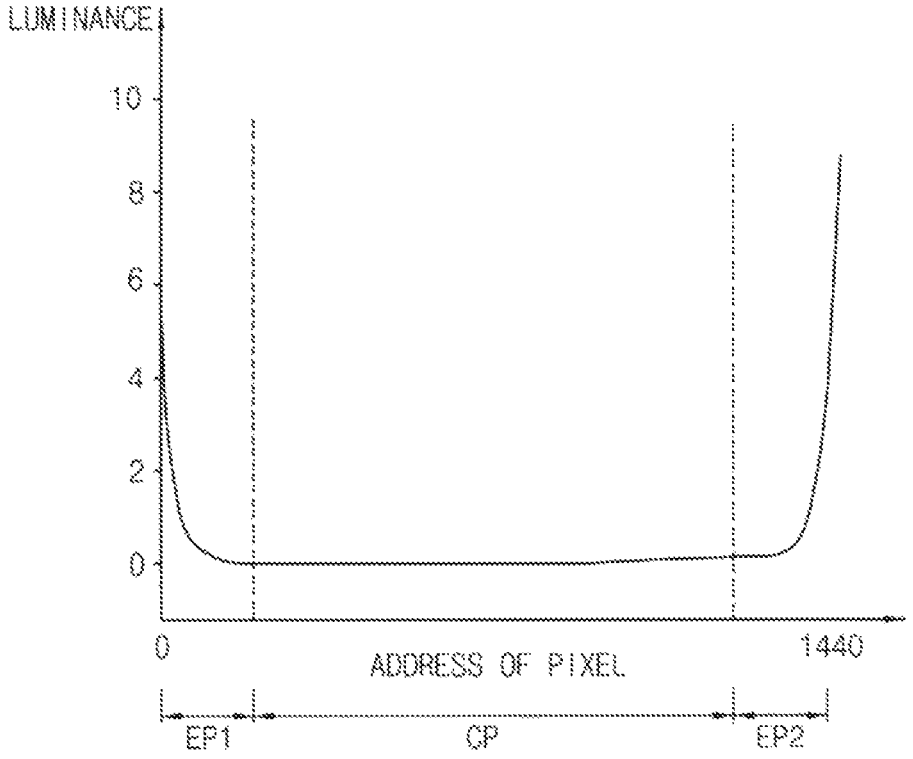
FIGS. 6A to 6C are graphs of luminance compensating values for compensating a curved portion of a display panel of FIG. 1.
Figure 6B:
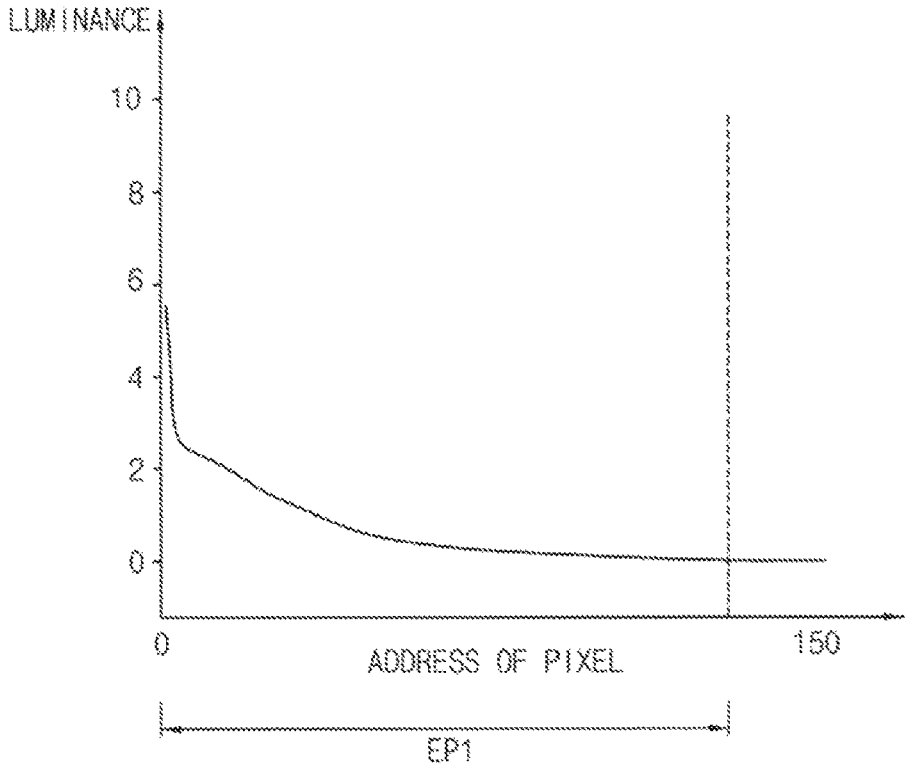
Figure 6C:
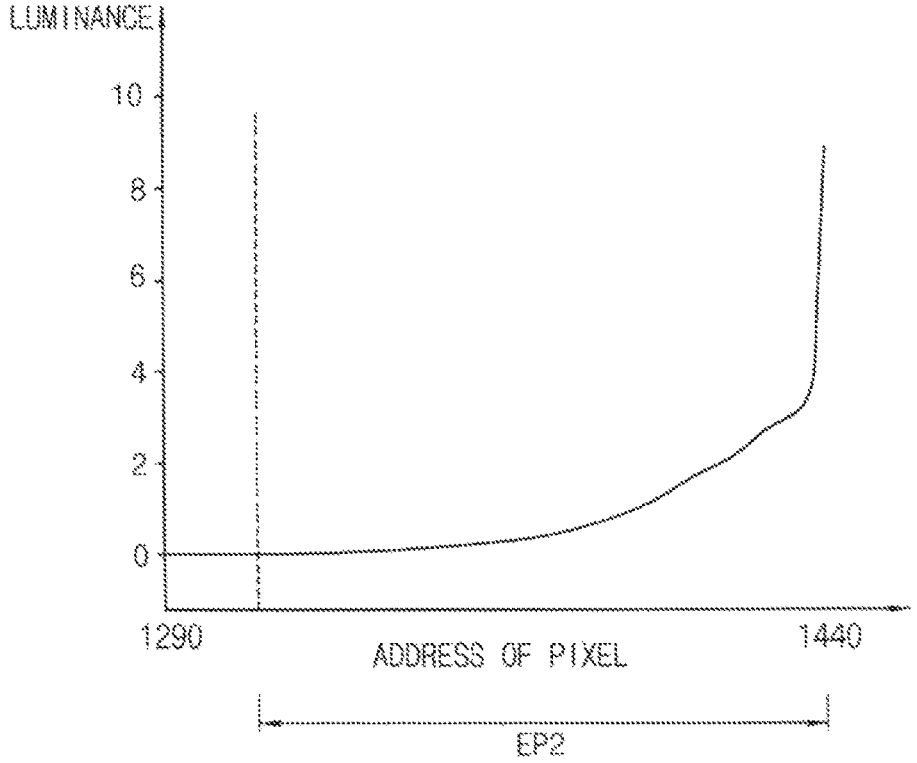
Figure 7:
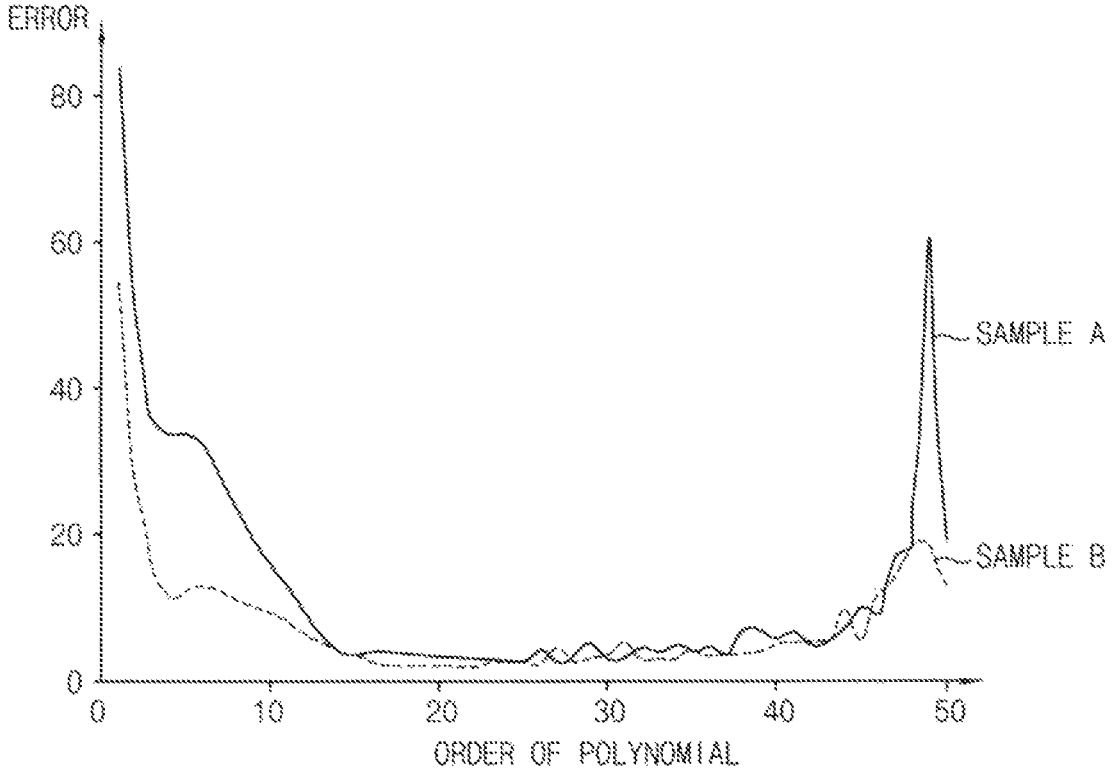
FIG. 7 is a graph of a difference between an n-th order polynomial and an actual luminance profile when a curved portion of a display panel of FIG. 1 is compensated using the n-th polynomial.
Figure 8:
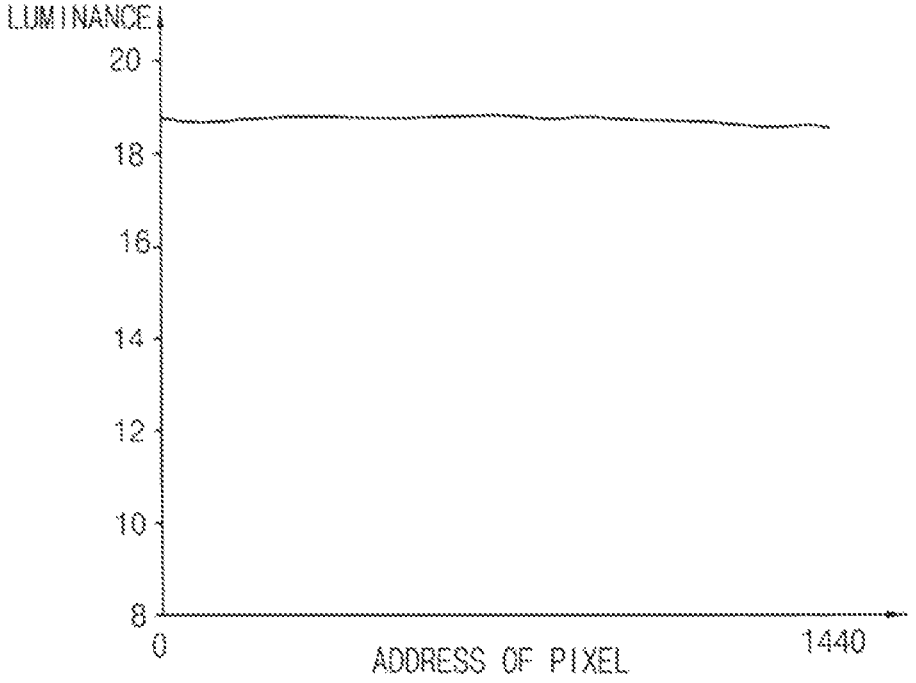
FIG. 8 is a graph of a compensated luminance profile generated by an edge compensating part of FIG. 3.

FIG. 3 is a block diagram of a stain compensating part of FIG. 1. FIG. 4 is a flowchart of a method of compensating a stain of a display panel using a stain compensating apparatus of FIG. 1. FIGS. 5A to 5C are graphs of a luminance profile of a display panel of FIG. 1. FIGS. 6A to 6C are graphs of luminance compensating values for compensating a curved portion of a display panel of FIG. 1. FIG. 7 is a graph of a difference between an n-th polynomial and an actual luminance profile when a curved portion of a display panel of FIG. 1 is compensated using the n-th polynomial. FIG. 8 is a graph of a compensated luminance profile generated by an edge compensating part of FIG. 3. FIGS. 9A and 9B are conceptual diagrams that illustrate a method of generating a stain compensating value by a stain compensating value generating part of FIG. 3.

Referring to FIGS. 1 to 9B, according to embodiments, the stain compensating part 300 includes an input signal processing part 320, an edge compensating part 340 and a stain compensating value generating part 360.

According to an embodiment, the camera 200 captures a display image on the display panel 150 (step S100).

According to an embodiment, the input signal processing part 320 generates a luminance profile PI based on the display image II captured by the camera 200 (step S200).

According to an embodiment, the input signal processing part 320 generates the luminance profile PI as a function of position along the first direction D1 when the curved portion is disposed at an end portion of the display panel 150 in the first direction D1.

According to an embodiment, the input signal processing part 320 uses an average of the luminance in the second direction D2 to generate the luminance profile PI as a function of position along the first direction D1.

According to an embodiment, the input signal processing part 320 simplifies a three-dimensional graph having a first axis in the first direction D1, a second axis in the second direction D2, and luminance values in a third direction normal to plane of the first direction D1 and the second direction D2 into a two-dimensional graph having a first axis in the first direction D1 and a second axis in the luminance. To simplify the three-dimensional graph into the two-dimensional graph, the luminance values in the second direction D2 are converted to one value by averaging the luminance values in the second direction D2.

For example, according to an embodiment, the display panel 150 has 1440 pixels in the first direction D1, and 3560 pixels in the second direction D2.

In FIG. 5A, according to an embodiment, the X axis represents the pixel address. For example, the X axis in FIG. 5A corresponds to the first direction D1. The Y axis represents the luminance. For example, the luminance value may be an average of the luminance of the 3560 pixels in the second direction D2.

As shown in the luminance profile of FIG. 5A, the central portion CP of the display panel 150 has a generally uniform luminance profile. In contrast, the first edge portion EP1 and the second edge portion EP2 of the display panel 150 have increasing or decreasing luminance profiles, respectively. FIG. 5B illustrates the luminance profile of the first edge portion EP1. FIG. 5C illustrates the luminance profile of the second edge portion EP2.

According to embodiments, the first edge portion EP1 and the second edge portion EP2 of the display panel 150 are curved, thus luminance in the image captured from the display panel 150 in the first edge portion EP1 and the second edge portion EP2 is relatively dark.

According to embodiments, when the display panel 150 is flat and the display panel stain is compensated using the image captured by the camera 200, the stain of the display panel 150 can be properly compensated. However, when the display panel 150 has a curved portion and the display panel stain is compensated using the image captured by the camera 200 without special processing for the curved portion, the luminance of the curved portion may be excessively bright.

Thus, according to embodiments, the luminance profile of the image captured by the camera 200 should be adjusted for the curved portion.

FIG. 6A is a graph of luminance compensating values for a luminance profile of the display panel 150 that includes curved portions.

In FIG. 6A, according to embodiments, the luminance profile of the central portion CP of the display panel 150 is not compensated. However, the luminance profiles of the first and second edge portions EP1 and EP2 of the display panel 150 are compensated.

According to embodiments, when the luminance profile of the display panel 150 is compensated, a compensated luminance profile will resemble the luminance profile of a flat display panel which does not include curved portions.

Therefore, according to embodiments, a stain can be compensated using the compensated luminance profile, and the display panel can be properly compensated despite the curved portion.

FIG. 6B illustrates luminance compensating values for the first edge portion EP1. FIG. 6C illustrates luminance compensating values for the second edge portion EP2.

Referring again to FIG. 3, according to embodiments, the edge compensating part 340 receives the luminance profile PI of the display image from the input image processing part 320. The edge compensating part 340 compensates the luminance profile PI of the curved portion to generate the compensated luminance profile CI (step S300).

According to embodiments, the edge compensating part 340 compensates the luminance profile of the curved portion EP1 and EP2 by curve fitting an n-th order polynomial. Herein, n is a natural number.

According to embodiments, the n-th polynomial has a form $a_n \times x^n + (a_{n-1}) \times x^{n-1} + (a_{n-2}) \times x^{n-2} + \ldots + a_1 \times x + a_0$, where $a_n$, $a_{n-1}$, $a_{n-2}$, . . . , $a_1$ and $a_0$ are real numbers.

According to embodiments, the edge compensating part 340 determines an n-th order polynomial that minimizes differences between the n-th order polynomial and the luminance profile of the curved portion. For example, the order n of the polynomial and the coefficients $a_n$, $a_{n-1}$, $a_{n-2}$, . . . , $a_1$ and $a_0$ can be determined by a Gauss-Newton algorithm.

FIG. 7 is the graph of a difference between an n-th order polynomial and actual luminance profiles of a curved portion as a function of the order of the polynomial. In FIG. 7 depicts measured differences between the graph of an n-th order polynomial and a luminance profile of the curved portions for two sample display apparatuses SAMPLE A and SAMPLE B. If the difference between an n-th order polynomial and a luminance profile of the curved portion is small, the graph of the n-th order polynomial will almost coincide with the luminance profile. As shown in FIG. 7, when the order of the polynomial is greater than or equal to 15, the differences between the n-th order polynomial and the luminance profile are small. However, as the order of the polynomial increases, the processing time to generate the compensated luminance profile increases. Thus, there may be an effective an upper limit to the order of the polynomial. For example, the order of the polynomial may have an upper limit of in the range of from about 15 to about 25.

According to embodiments, FIG. 8 illustrates the compensated luminance profile CI generated by the edge compensating part 340. The increasing and decreasing luminance profiles PI at the edge portions EP1 and EP2 are compensated by the edge compensating part 340 so that the compensated luminance profile CI has a generally uniform luminance profile regardless of the edge portions EP1 and EP2.

According to embodiments, the stain compensating value generating part 360 generates stain compensating values CC for pixels of the display panel 150 using the compensated luminance profile CI (step S400). The stain compensating value generating part 360 generates a stain compensating value CC for each pixel. The stain compensating value CC of a pixel disposed in the curved portions EP1 and EP2 of the display panel 150 is generated based on the compensated luminance profile CI.

FIGS. 9A and 9B illustrate a method of generating stain compensating values CC by the stain compensating value generating part 360. Although FIGS. 9A and 9B show the display panel 150 as including five pixel rows PR1 to PR5 and three pixel columns PC1 to PC3 for convenience of explanation, embodiments of the present inventive concept are not limited thereto. The display panel 150 may include further pixels. For example, the display panel 150 may include 3560×1440 pixels.

In FIG. 9A, according to embodiments, LM represents an average luminance of the display panel 150. LM+1 represents a luminance which is brighter than the average luminance LM by one unit. LM+3 represents a luminance which is brighter than the average luminance LM by three units. LM+4 represents a luminance which is brighter than the average luminance LM by four units. LM−1 represents a luminance which is darker than the average luminance LM by one unit. LM−2 represents a luminance which is darker than the average luminance LM by two units. LM−3 represents a luminance which is darker than the average luminance LM by three units.

In FIG. 9B, according to embodiments, X represents a luminance compensating value that compensates the darker than average luminance value LM−1. 2X represents the luminance compensating value that compensates the darker than average luminance value LM−2. 3X represents the luminance compensating value that compensates the darker than average luminance value LM−3. −X represents the luminance compensating value that compensates the brighter than average luminance value LM+1. −3X represents the luminance compensating value that compensates the brighter than average luminance value LM+3. −4X represents the luminance compensating value that compensates the brighter than average luminance value LM+4.

According to embodiments, the stain compensating value generating part 360 generates positive luminance compensating values for pixels having darker than average luminance LM. The stain compensating value generating part 360 generates negative luminance compensating values for pixels having brighter than average luminance LM.

For example, according to embodiments, a pixel in a first pixel row PR1 and a first pixel column PC1 that has a luminance brighter than the average luminance LM by one unit has a luminance compensating value of −X.

For example, according to embodiments, a pixel in the first pixel row PR1 and a second pixel column PC2 that has an average luminance LM has a luminance compensating value of zero.

For example, according to embodiments, a pixel in a second pixel row PR2 and the first pixel column PC1 that has a luminance darker than the average luminance LM by one unit has a luminance compensating value of X.

According to a present exemplary embodiment, the display panel 150 that has curved portions can be properly compensated based on a captured display image without considering the curvature of the curved portions. Thus, the display quality of the display panel 150 can be improved.

Figure 10:
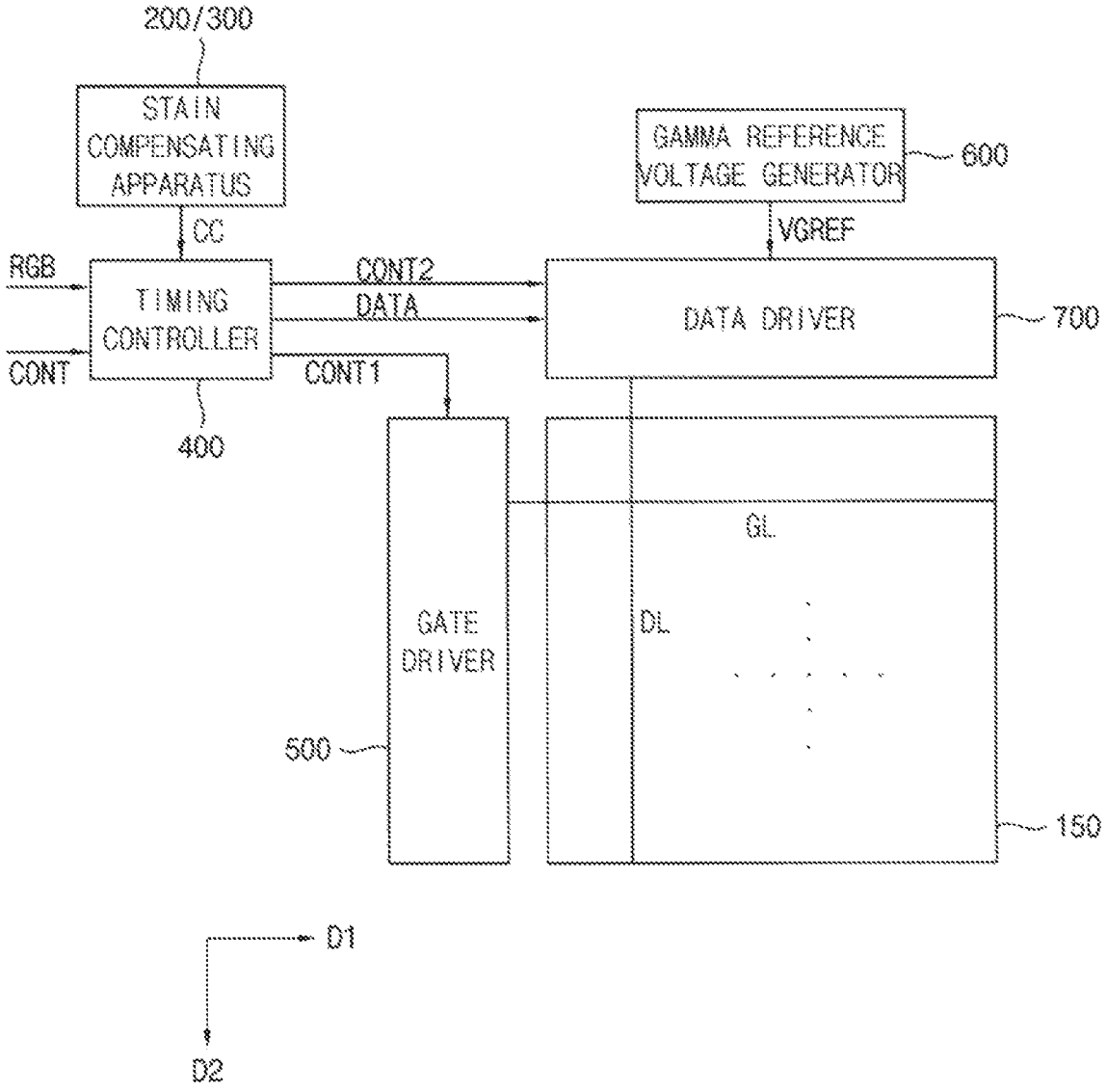
FIG. 10 is a block diagram of a display apparatus that drives a display panel according to an exemplary embodiment of the present inventive concept.
Figure 11:
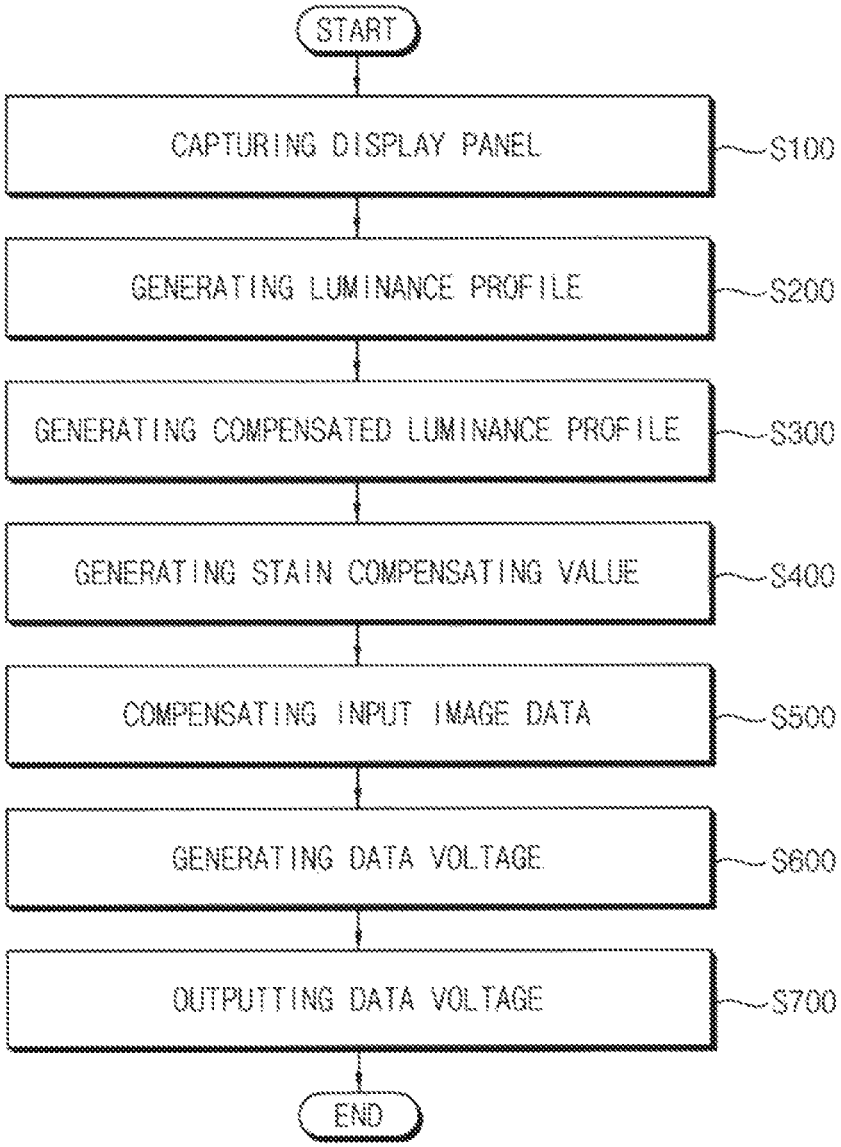
FIG. 11 is a flowchart of a method of driving a display panel of FIG. 10.

FIG. 10 is a block diagram of a display apparatus that drives a display panel according to an exemplary embodiment of the present inventive concept. FIG. 11 is a flowchart of a method of driving a display panel of FIG. 10.

A method of driving a display panel according to a present exemplary embodiment includes a method of compensating stain of the display panel described with reference to FIGS. 1 to 9B. Thus, the same reference numerals may be used to refer to the same or similar parts as those described in the previous exemplary embodiments of FIGS. 1 to 9B and any repetitive explanation concerning the above elements may be omitted.

Referring to FIGS. 1 to 3, 10 and 11, a display apparatus according to embodiments includes the display panel 150, a timing controller 400, a gate driver 500, a gamma reference voltage generator 600 and a data driver 700. The stain compensating apparatus includes the camera 200 and the stain compensating part 300. Herein, the stain refers to an area having an abnormal luminance which is relatively high or relatively low as compared to an average luminance.

According to embodiments, the display panel 150 includes a plurality of gate lines GL, a plurality of data lines DL and a plurality of pixels connected to the gate lines GL and the data lines DL.

According to embodiments, the gate lines GL extend in a first direction D1, and the data lines DL extend in a second direction D2 crossing the first direction D1. In some embodiments, the first direction D1 is perpendicular to the second direction D2.

According to embodiments, the timing controller 400 receives input image data RGB and an input control signal CONT from an external apparatus. The input image data RGB includes red grayscale data R, green grayscale data G and blue grayscale data B. The input control signal CONT includes a master clock signal, a data enable signal, a vertical synchronizing signal and a horizontal synchronizing signal.

According to embodiments, the timing controller 400 receives the stain compensating value CC from the stain compensating part 300.

According to embodiments, the timing controller 400 generates a first control signal CONT1, a second control signal CONT2 and a data signal DATA based on the input image data RGB, the stain compensating value COMP and the input control signal CONT.

According to embodiments, the timing controller 400 generates the first control signal CONT1 to control a driving timing of the gate driver 500 based on the input control signal CONT, and outputs the first control signal CONT1 to the gate driver 500. The first control signal CONT1 includes a vertical start signal and a gate clock signal.

According to embodiments, the timing controller 400 generates the second control signal CONT2 to control a driving timing of the data driver 700 based on the input control signal CONT, and outputs the second control signal CONT2 to the data driver 700. The second control signal CONT2 includes a horizontal start signal and a load signal.

According to embodiments, the timing controller 400 generates the data signal DATA based on the input image data RGB and the stain compensating value CC, and outputs the data signal DATA to the data driver 700.

According to embodiments, the gate driver 500 receives the first control signal CONT1 from the timing controller 400. The gate driver 500 generates gate signals that drive the gate lines GL in response to the first control signal CONT1. The gate driver 500 sequentially outputs the gate signals to the gate lines GL.

According to embodiments, the gamma reference voltage generator 600 generates a gamma reference voltage VGREF. The gamma reference voltage generator 600 provides the gamma reference voltage VGREF to the data driver 700. The gamma reference voltages VGREF have values corresponding to the data signal DATA. The gamma reference voltage generator 600 may be disposed in the data driver 700.

According to embodiments, the data driver 700 receives the second control signal CONT2 and the data signal DATA from the timing controller 400. The data driver 700 receives the gamma reference voltage VGREF from the gamma reference voltage generator 600.

According to embodiments, the data driver 700 converts the data signal DATA into analog data voltages using the gamma reference voltage VGREF. The data driver 700 sequentially outputs the data voltages to the data lines DL.

Referring now to FIG. 11, according to embodiments, the camera 200 captures the display image being displayed on the display panel 150 (step S100). The input signal processing part 320 of the stain compensating part 300 generates the luminance profile PI based on the captured display image (step S200). The edge compensating part 340 compensates the luminance profile PI of the curved portion to generate the compensated luminance profile CI (step S300). The stain compensating value generating part 360 generates stain compensating values CC for pixels of the display panel 150 using the compensated luminance profile CI (step S400).

According to embodiments, the timing controller 400 compensates the input image data RGB using the stain compensating value CC (step S500).

According to embodiments, the data driver 700 generates data voltages based on the compensated input image data RGB (step S600).

According to embodiments, the data driver 700 outputs the data voltages to the display panel 150 (step S700).

According to a present exemplary embodiment, the display panel 150 that has curved portions can be properly compensated based on the captured display image without considering the curvature of the curved portion. Thus, the display quality of the display panel 150 can be improved.

According to a stain compensating apparatus and a method of compensating stain and a method of driving a display panel according to an embodiment of the present inventive concept, a luminance profile of a curved portion is compensated to a flat luminance profile to generate a compensated luminance profile. A stain of a display panel is compensated using the compensated luminance profile so that the stain of the curved portion of the display panel can be properly compensated. Thus, the display quality of the display panel may be improved.

The foregoing is illustrative of embodiments of the present inventive concept and is not to be construed as limiting thereof. Although a few exemplary embodiments of the present inventive concept have been described, those skilled in the art will readily appreciate that many modifications are possible in the exemplary embodiments without materially departing from the novel teachings and advantages of embodiments of the present inventive concept. Accordingly, all such modifications are intended to be included within the scope of embodiments of the present inventive concept as defined in the claims. The present inventive concept is defined by the following claims, with equivalents of the claims to be included therein.

What is claimed is:

1. A stain compensating apparatus for a display panel, comprising:

a camera that captures a display image from the display panel;

an input signal processing part that generates a luminance profile based on the display image captured by the camera;

an edge compensating part that compensates the luminance profile of an edge portion of the display panel; and a stain compensating value generating part that generates a stain compensating value for a pixel of the display panel using the compensated luminance profile.

2. The stain compensating apparatus of claim 1, wherein the edge portion is disposed at an end portion of the display panel in a first direction, and the input signal processing part generates the luminance profile as a function of position along the first direction.

3. The stain compensating apparatus of claim 2, wherein the input signal processing part generates the luminance profile using an average of luminances in a second direction crossing the first direction.

4. The stain compensating apparatus of claim 1, wherein the edge compensating part determines an n-th order polynomial that minimizes differences between the n-th order polynomial and the luminance profile of the edge portion, wherein n is a natural number.

5. The stain compensating apparatus of claim 4, wherein the n-th order polynomial has a form $a_n \times x^n + (a_{n-1}) \times x^{n-1} + (a_{n-2}) \times x^{n-2} + \ldots + a_1 \times x + a_0$, wherein $a_{n-1}$, $a_{n-2}$, . . ., $a_1$ and $a_0$ are real numbers.

6. The stain compensating apparatus of claim 1, wherein the stain compensating value generating part generates the stain compensating value for each pixel, and the stain compensating value for a pixel disposed at the edge portion of the display panel is based on the compensated luminance profile.

7. The stain compensating apparatus of claim 6, wherein the stain compensating value generating part generates a positive luminance compensating value for the pixel whose luminance is darker than an average luminance of the display panel and a negative luminance compensating value for a pixel whose luminance is brighter than the average luminance of the display panel.

8. A method of compensating stain of a display panel, the method comprising:

capturing a display image from the display panel;

generating a luminance profile based on the display image;

compensating the luminance profile of an edge portion of the display panel to generate a compensated luminance profile; and generating a stain compensating value for a pixel of the display panel using the compensated luminance profile.

9. The method of claim 8, wherein the edge portion is disposed at an end portion of the display panel in a first direction, and the luminance profile is a function of position along the first direction.

10. The method of claims 9, wherein the luminance profile is generated using an average of luminances in a second direction crossing the first direction.

11. The method of claim 8, wherein compensating the luminance profile comprises determining an n-th order polynomial that minimizes differences between the n-th order polynomial and the luminance profile of the edge portion, wherein n is a natural number.

12. The method of claim 11, wherein the n-th order polynomial has a form $a_n \times x^n + (a_{n-1}) \times x^{n-1} + (a_{n-2}) \times x^{n-2} + \ldots + a_1 \times x + a_0$, wherein $a_n$, $a_{n-1}$, $a_{n-2}$, . . ., $a_1$ and $a_0$ are real numbers.

13. The method of claim 8, wherein the stain compensating value is generated for each pixel, and the stain compensating value for a pixel disposed at the edge portion of the display panel is based on the compensated luminance profile.

14. The method of claim 13, wherein a positive luminance compensating value is generated for a pixel whose luminance is darker than an average luminance of the display panel, and a negative luminance compensating value is generated for a pixel whose luminance is brighter than the average luminance of the display panel.

15. The method of claim 8, further comprising:

compensating an input image data based on the stain compensating value;

generating a data voltage based on the compensated input image data; and outputting the data voltage to the display panel.

16. A stain compensating apparatus for a display panel, comprising:

an input signal processing part that generates a luminance profile based on a display image;

an edge compensating part that compensates the luminance profile of an edge portion of the display panel by determining an n-th order polynomial that minimizes differences between the n-th order polynomial and the luminance profile of the edge portion, wherein n is a natural number; and a stain compensating value generating part that generates a stain compensating value for a pixel of the display panel using the compensated luminance profile.

17. The stain compensating apparatus of claim 16, wherein the edge portion is disposed at an end portion of the display panel in a first direction, and the luminance profile is a function of position along the first direction generated using an average of luminances in a second direction crossing the first direction.

18. The stain compensating apparatus of claim 16, wherein the n-th order polynomial has a form $a_n \times x^n + (a_{n-1}) \times x^{n-1} + (a_{n-2}) \times x^{n-2} + \ldots + a_1 \times x + a_0$, wherein $a_{n-1}$, $a_{n-2}$, . . ., $a_1$ and $a_0$ are real numbers.

19. The stain compensating apparatus of claim 16, wherein the stain compensating value generating part generates the stain compensating value for each pixel, and the stain compensating value generating part generates a positive luminance compensating value for the pixel whose luminance is darker than an average luminance of the display panel and a negative luminance compensating value for a pixel whose luminance is brighter than the average luminance of the display panel.

20. The stain compensating apparatus of claim 16, further comprising a camera that captures the display image from the display panel.

* * * * *